US011661797B2

(12) United States Patent
Sjöholm et al.

(10) Patent No.: US 11,661,797 B2
(45) Date of Patent: May 30, 2023

(54) MINING OR CONSTRUCTION VEHICLE AND A HYDRAULIC CYLINDER CONDUIT ENCLOSING A CONDUIT ARRANGEMENT

(71) Applicant: EPIROC ROCK DRILLS AKTIEBOLAG, Örebro (SE)

(72) Inventors: Oskar Sjöholm, Örebro (SE); Patrik Roth, Vintrosa (SE); Fredrik A. Andersson, Örebro (SE); Per-Anders Kumlin, Västra Frölunda (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 431 days.

(21) Appl. No.: 16/645,410

(22) PCT Filed: Jun. 11, 2018

(86) PCT No.: PCT/EP2018/065311

§ 371 (c)(1),
(2) Date: Mar. 6, 2020

(87) PCT Pub. No.: WO2019/048094

PCT Pub. Date: Mar. 14, 2019

(65) Prior Publication Data

US 2020/0284097 A1 Sep. 10, 2020

(30) Foreign Application Priority Data

Sep. 8, 2017 (SE) ..... 1751090-0

(51) Int. Cl.
*E21B 7/02* (2006.01)

(52) U.S. Cl.
CPC ..... *E21B 7/023* (2013.01); *E21B 7/022* (2013.01); *E21B 7/025* (2013.01)

(58) Field of Classification Search
CPC ..... E21B 7/023; E21B 7/022; E21B 7/025; E21B 7/02
See application file for complete search history.

(56) References Cited

U.S. PATENT DOCUMENTS 1,851,940 A 3/1932 Williams
2,813,692 A 11/1957 Bremer et al.
(Continued)

FOREIGN PATENT DOCUMENTS

CN 201071851 Y 6/2008
CN 104695871 A 6/2015
(Continued)

OTHER PUBLICATIONS

International Search Report and Written Opinion in corresponding International Application No. PCT/EP2018/065311 dated Dec. 14, 2018 (20 pages).

(Continued)

*Primary Examiner* — Taras P Bemko
(74) *Attorney, Agent, or Firm* — Sage Patent Group

(57) ABSTRACT

A mining or construction vehicle comprising an extendable boom comprised of a first and a second telescopic section extending in a longitudinal direction, wherein the first telescopic section is arranged to be connected to the mining or construction vehicle and a hydraulic device is arranged to be connected to a mounting device at a free end of the second telescopic section, wherein a hydraulic cylinder is arranged in connection to the extendable boom to govern extension of said extendable boom. Hydraulic conduit for supply of hydraulic fluid to the hydraulic device on the mounting device are arranged through the length of the extendable boom.

18 Claims, 4 Drawing Sheets

(56) References Cited

U.S. PATENT DOCUMENTS

| | | | | |
|---|---|---|---|---|
| 3,187,916 | A | 6/1965 | O'Leary | |
| 3,207,044 | A | 9/1965 | Hall | |
| 3,315,821 | A | 4/1967 | Grove | |
| 3,623,501 | A | 11/1971 | Reimbold | |
| 3,664,527 | A * | 5/1972 | Short | E02F 3/425 414/718 |
| 3,696,712 | A | 10/1972 | Sung | |
| 3,800,664 | A * | 4/1974 | Phillips | E21C 37/22 91/308 |
| 3,920,084 | A | 11/1975 | Russell, Jr. | |
| 3,980,142 | A | 9/1976 | Grigoriev et al. | |
| 4,023,836 | A | 5/1977 | Applehans | |
| 4,199,299 | A | 4/1980 | Petitto, Sr. et al. | |
| 4,214,780 | A | 7/1980 | Grace | |
| 4,344,599 | A * | 8/1982 | Herron | E21B 7/022 173/28 |
| 4,382,619 | A | 5/1983 | Grisebach | |
| 4,459,898 | A | 7/1984 | Harjar et al. | |
| 4,534,584 | A | 8/1985 | Weirich et al. | |
| 4,536,017 | A | 8/1985 | Weirich et al. | |
| 4,544,185 | A | 10/1985 | Weirich et al. | |
| 4,601,000 | A | 7/1986 | Montabert | |
| 5,458,375 | A | 10/1995 | Anspach, Jr. et al. | |
| 5,558,118 | A | 9/1996 | Mooring | |
| 5,896,935 | A | 4/1999 | Esko et al. | |
| 5,954,143 | A | 9/1999 | McCabe et al. | |
| 6,364,142 | B1 | 4/2002 | Kaspar | |
| 6,435,235 | B1 | 8/2002 | Hicks | |
| 8,267,194 | B2 | 9/2012 | Saf | |
| 2002/0056573 | A1 | 5/2002 | Akerlund | |
| 2005/0258295 | A1 | 11/2005 | Wireman | |
| 2008/0093525 | A1* | 4/2008 | Saf | E21B 7/025 248/674 |
| 2010/0163258 | A1 | 7/2010 | Hughes, IV et al. | |
| 2010/0300567 | A1 | 12/2010 | Svensson | |
| 2014/0214278 | A1 | 7/2014 | Kuipers et al. | |
| 2014/0367529 | A1 | 12/2014 | Choi et al. | |
| 2017/0129088 | A1 | 5/2017 | Kabiraj et al. | |
| 2021/0285571 | A1* | 9/2021 | Taillon | F16L 3/221 |

FOREIGN PATENT DOCUMENTS

| | | | |
|---|---|---|---|
| CN | 103470183 | B | 10/2015 |
| CN | 205370442 | U | 7/2016 |
| DE | 4222007 | A1 | 1/1994 |
| DE | 4318872 | A1 | 12/1994 |
| DE | 102011115634 | A1 | 9/2012 |
| EP | 0003006 | A1 | 7/1979 |
| EP | 0066755 | A1 | 12/1982 |
| EP | 0434652 | A1 | 6/1991 |
| EP | 0835971 | A1 | 4/1998 |
| EP | 1707529 | A1 | 10/2006 |
| EP | 2154412 | A1 | 2/2010 |
| EP | 1448471 | B1 | 1/2011 |
| EP | 3059382 | A1 | 8/2016 |
| FI | 84642 | B | 9/1991 |
| FR | 1408620 | A | 8/1965 |
| FR | 2328836 | A1 | 5/1977 |
| GB | 908133 | A | 10/1962 |
| GB | 1234981 | A | 6/1971 |
| GB | 1262666 | A | 2/1972 |
| GB | 1469661 | A | 4/1977 |
| GB | 2074686 | A | 11/1981 |
| JP | S604647 | U | 1/1985 |
| JP | H082876 | A | 1/1996 |
| JP | H1052390 | A | 2/1998 |
| JP | 2004156299 | A | 6/2004 |
| JP | 2005201323 | A | 7/2005 |
| JP | 2006256828 | A | 9/2006 |
| KR | 20000030293 | A | 6/2000 |
| KR | 20090059361 | A | 6/2009 |
| SE | 303115 | B | 8/1968 |
| SE | 390528 | B | 12/1976 |
| SE | 500903 | C2 | 9/1994 |
| SE | 528389 | C2 | 10/2006 |
| SE | 535073 | C2 | 4/2012 |
| SE | 535386 | C2 | 7/2012 |
| SE | 536794 | C2 | 8/2014 |
| WO | 9010588 | A1 | 9/1990 |
| WO | 02097316 | A1 | 12/2002 |
| WO | 2006056849 | A2 | 6/2006 |
| WO | 2006096110 | A1 | 9/2006 |
| WO | 2009124957 | A1 | 10/2009 |
| WO | 2010110759 | A2 | 9/2010 |
| WO | 2010122212 | A1 | 10/2010 |
| WO | 2014206471 | A1 | 12/2014 |
| WO | 2017058091 | A1 | 4/2017 |
| WO | WO-2018184105 | A1 * | 10/2018 | E02F 9/2275 |

OTHER PUBLICATIONS

International-type Search Report in Priority Swedish Application No. 1751090-0 dated Apr. 5, 2018 (6 pages).

* cited by examiner

MINING OR CONSTRUCTION VEHICLE AND A HYDRAULIC CYLINDER CONDUIT ENCLOSING A CONDUIT ARRANGEMENT

CROSS-REFERENCE TO RELATED APPLICATIONS

This application is a U.S. National Stage application of PCT/EP2018/065311, filed Jun. 11, 2018 and published on Mar. 14, 2019 as WO/2019/048094, which claims the benefit of Swedish Patent Application No. 1751090-0, filed Sep. 8, 2017, all of which are hereby incorporated by reference in their entireties.

TECHNICAL FIELD

The invention relates to a mining or construction vehicle and to a hydraulic cylinder enclosing a conduit arrangement in connection to a mining or construction vehicle. Specifically, the invention involves a conduit arrangement adapted to be extended during operation.

BACKGROUND

In mining and construction industry hydraulic devices, such as a rock drilling machines, are often arranged on a movable arm or the like of a mining or construction vehicle. Such hydraulic devices often include several hydraulic components which need to be supplied with hydraulic fluid, and in some cases flushing medium and pressurised air also need to be supplied to the hydraulic device, such that additional conduits need to be provided along the movable arm.

In WO 2006/096110 A1 a rotation device for a boom of a mining or construction work rig is disclosed. The arrangement of WO 2006/096110 A1 comprises a hydraulic device in the form of a drilling machine. Although not shown in the disclosure of WO 2006/096110 A1, the hydraulic device therein is provided with hydraulic fluid via hoses arranged in flexible reel arrangements allowing the different parts of the rig arm arrangement to rotate and pivot with respect to each other.

Such a system is problematic due to the fact that the hoses are exposed to the harsh environment of a mining or construction vehicle risking that a hose may rupture. Conventionally, a major part of the downtime of a mining or construction vehicle with a hydraulic device arranged on an arm that extends out from the vehicle is due to problems with the provision of hydraulic fluid in one way or another. Further, the many hoses may impede the visibility for the operator controlling the mining or construction vehicle.

Hence there is a need of an arrangement that improves the conduit arrangement on a mining or construction vehicle.

SUMMARY OF THE INVENTION

It is an object of the present invention to provide a mining or construction vehicle with an improved conduit arrangement.

According to a first aspect the invention relates to mining or construction vehicle with an extendable boom comprising at least a first and a second telescopic section extending in a longitudinal direction, wherein the first telescopic section is arranged to be connected to the mining or construction vehicle and a hydraulic device is arranged to be connected to a mounting device in connection to a free end of the second telescopic section, wherein a hydraulic cylinder is arranged in connection to the extendable boom to govern extension of said extendable boom. Further, a at least one hydraulic conduit for supply of hydraulic fluid to the hydraulic device on the mounting device is arranged inside the extendable boom.

In a specific embodiment, the hydraulic cylinder is arranged inside the extendable boom. Further, the hydraulic conduit for supply of hydraulic fluid to the hydraulic device may be arranged inside said hydraulic cylinder.

In a specific embodiment, the hydraulic conduits are arranged through the free end of the second telescopic section of the extendable boom. Preferably, the hydraulic conduit extends substantially in parallel with the extendable boom in the longitudinal direction out from the free end of the second telescopic section of the extendable boom. The conduit for supply to the hydraulic device may be telescopically extendable.

In a specific embodiment, the mining or construction vehicle is a drill rig and the hydraulic device is a hydraulic percussive drilling machine.

Further, the hydraulic percussive drilling machine comprises a percussive unit and wherein the hydraulic conduit is arranged to supply the percussive unit with hydraulic fluid.

In a specific embodiment, the four different hydraulic conduits are arranged alongside inside the extendable boom, a first conduit to a percussive unit of the drilling machine, a second conduit to a rotation motor of the drilling machine, a third conduit to a feed device for feeding the drilling machine back and forth, and a fourth conduit for a return flow to tank.

According to a second aspect the invention relates to a hydraulic cylinder, in which hydraulic conduits are arranged for feeding pressurised hydraulic fluid to a hydraulic device, wherein a command unit is arranged to command the extension of the hydraulic cylinder, a sensor is arranged to monitor the extension of the hydraulic cylinder, and a control unit is arranged to compare said monitored extension with the commanded extension.

In a specific embodiment, an alert signal is issued when the control unit detects a discrepancy between the monitored extension and the commanded extension of the hydraulic cylinder.

In one specific embodiment, a feed system is arranged to compensate a fluid volume in at least one conduit for supply of hydraulic fluid to the hydraulic device, and wherein the control unit is arranged to control a supply of hydraulic fluid to the hydraulic conduit corresponding to the increased volume of said hydraulic conduit, and, when the hydraulic conduit is compacted, the control unit is arranged to control a discharge of hydraulic fluid from the hydraulic conduit corresponding to the decreased volume of said hydraulic conduit due to that it is being compacted.

In one specific embodiment, the hydraulic device is a rock drilling machine that may operate at a different hammering frequencies, and wherein the control unit is arranged to control the operation of the drilling machine so as to avoid hammering frequencies that has been identified to be prone to produce resonances in the hydraulic conduit and/or to control the extension of the extendable boom so as to avoid an extension of the hydraulic conduit that may interfere with a desired hammering frequency.

The invention also relates to a mining or construction vehicle comprising an extendable boom with at least a first and a second telescopic section extending in a longitudinal direction, wherein the first telescopic section is arranged to be connected to the mining or construction vehicle and a hydraulic device is arranged to be connected to a mounting device in connection to a free end of the second telescopic section, which mining or construction vehicle comprises a hydraulic cylinder as described above, in which at least one hydraulic conduit is arranged for feeding pressurised hydraulic fluid to the hydraulic device.

In another embodiment, the invention may relate to an extendable boom comprising at least a first and a second telescopic section extending in a longitudinal direction, wherein a hydraulic percussive drilling machine is arranged to be connected to a mounting device in connection to a free end of the second telescopic section, wherein a cylinder is arranged in connection to the extendable boom, and wherein at least one hydraulic conduit, typically a telescopic conduit, for supply of hydraulic fluid to the hydraulic device on the mounting device, is arranged inside the hydraulic cylinder, at least partly embedded in a fluid, e.g. a hydraulic fluid, inside said hydraulic cylinder.

The cylinder comprising the at least on hydraulic conduit may be a hydraulic cylinder arranged to also govern the extension of the extendable boom or, as an alternative, the extension may be governed by a second hydraulic cylinder.

By arranging the at least one hydraulic conduit inside the hydraulic cylinder, at least partly embedded in a hydraulic fluid, the self-oscillation of said hydraulic conduit will be restricted. This is useful both if the hydraulic cylinder is arranged inside the extendable boom or on the outside of the extendable boom. The fluid may be the hydraulic fluid arranged as working fluid inside the cylinder, but it can also be another fluid specifically chosen to dampen oscillations of the conduits.

Other embodiments and advantages of the invention will be apparent from the, dependent claims, detailed description and the appended drawings.

BRIEF DESCRIPTION OF DRAWINGS

An exemplary embodiment related to the invention will now be described with reference to the appended drawings, in which.

DETAILED DESCRIPTION OF EMBODIMENTS

Figure 1:
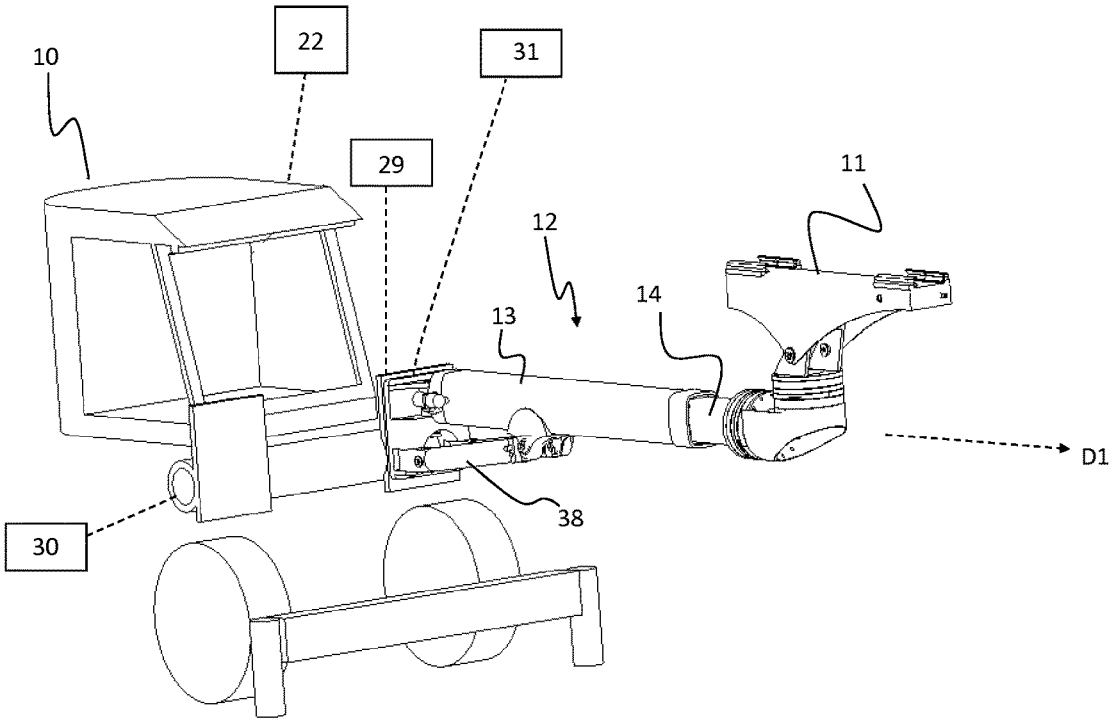
FIG. 1 is a schematic view of a mining or construction vehicle.

In FIG. 1 a mining or construction vehicle 10 according to an aspect of the invention is shown. The mining or construction vehicle 10 comprises an extendable boom 12 with a first and a second telescopic section 13 and 14, respectively, extending in a longitudinal direction D1, i.e. the axial direction, of the extendable boom 12. The first telescopic section 13 is arranged to be connected to the mining or construction vehicle 10 and a hydraulic device (not shown) is arranged on a mounting device 11 in connection to a free end 18 of the second telescopic section 14 of the extendable boom 12. In a specific embodiment, the vehicle is a drill rig and the hydraulic device is a hydraulic rock drilling machine, typically comprising a percussive drill hammer. The mounting device 11 of the shown embodiment is arranged in connection to the free end 18 of the second telescopic section 14, but the fact that it is arranged in connection to a free end 18 of the second telescopic section 14 of the extendable boom 12 should be construed as it may be arranged at a distance from the extendable boom 12, e.g. connected via a further boom or the like.

The extendable boom 12 may comprise more than two telescopic sections, wherein additional sections may be telescopically arranged between the first and second telescopic sections 13 and 14. In the shown embodiment, the mounting device 11 arranged to carry the hydraulic device is arranged on a pivot arm at the free end 18 of the extendable boom 12. The mounting device 11 may e.g. be comprised of a mounting plate, a bracket, a holder or a set of mounting holes for attachment of a hydraulic device.

Figure 2:
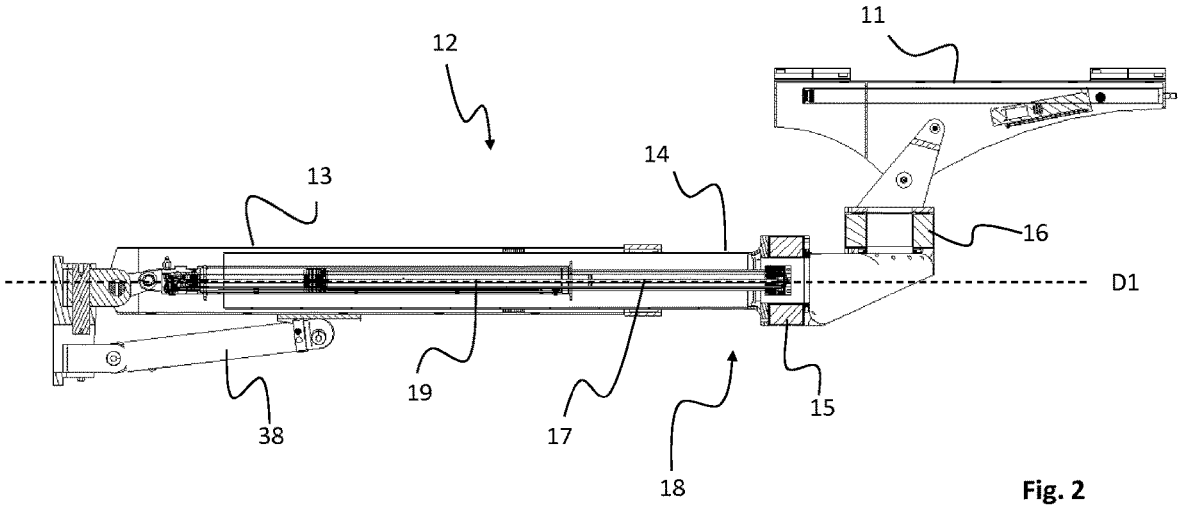
FIG. 2 is a schematic view of an extendable boom.

The extendable boom 12 is shown in a longitudinal section in FIG. 2. A hydraulic cylinder 19 is arranged in connection to the extendable boom 12 to govern the extension of said extendable boom 12. In the shown embodiment, the hydraulic cylinder 19 is arranged inside the extendable boom 12. The extendable boom 12 is connected to the hydraulic device arranged on the mounting device 11 via a first and a second rotation device 15 and 16, respectively.

Figure 3:
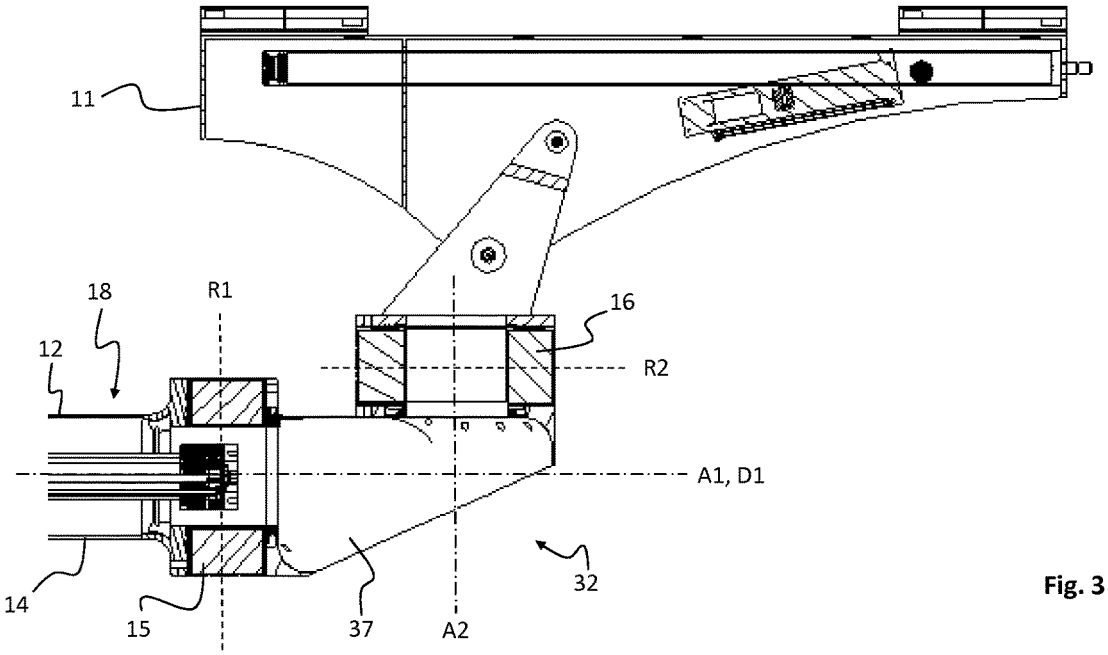
FIG. 3 is an illustrative view of the geometry of the free end of an extendable boom.

As is illustrated in FIG. 3, the first rotation device 15 is arranged at a free end 18 of the extendable boom 12 to provide a rotation R1 around a first axis A1 that is substantially parallel to the longitudinal direction D1. In the shown embodiment, the first axis A1 coincides with and is parallel to the longitudinal direction D1 of the extendable boom 12. The second rotation device 16 is arranged to provide a rotation R2 around a second axis A2 that is arranged at an angle with respect to the first axis A1. The rotation devices are interconnected by an angle unit 32, which comprises an intermediate part 37 with a first attachment device for attachment to a rotating part of the first rotation device 15, and a second attachment device for attachment to the second rotation device 16. The first and second attachment devices of the intermediate part 37 are arranged at an angle with respect to each other, said angle corresponding to the angle between the first rotation axis A1 and the second rotation axis A2. This angle is preferably about 90° and preferably larger than 60° or more preferably larger than 80°, and preferably smaller than 120°, more preferably smaller than 110°.

The hydraulic device arranged on the mounting device 11 needs pressurised hydraulic fluid to function. The pressurised hydraulic fluid is provided from a pressure source 30 on the mining or construction vehicle 10. In the shown embodiment, the hydraulic conduits 17 for supply of hydraulic fluid to the hydraulic device are arranged through the extendable boom 12. Specifically, the hydraulic conduits 17 are arranged inside the hydraulic cylinder 19. Further, additional conduits, such as conduits for providing flushing medium and pressurised air to the hydraulic device are provided. In a preferred embodiment, such additional conduits are also arranged inside the extendable boom 12.

In a not shown embodiment the hydraulic cylinder 19 may be arranged outside of the extendable boom 12. The hydraulic conduits 17 may however still be arranged inside the extendable boom 12. Further, both the hydraulic cylinder 19 and the hydraulic conduits 17 may be arranged inside the extendable boom 12, side by side, i.e. with the hydraulic conduits inside the extendable boom 12 but outside the hydraulic cylinder 19.

Figure 4:
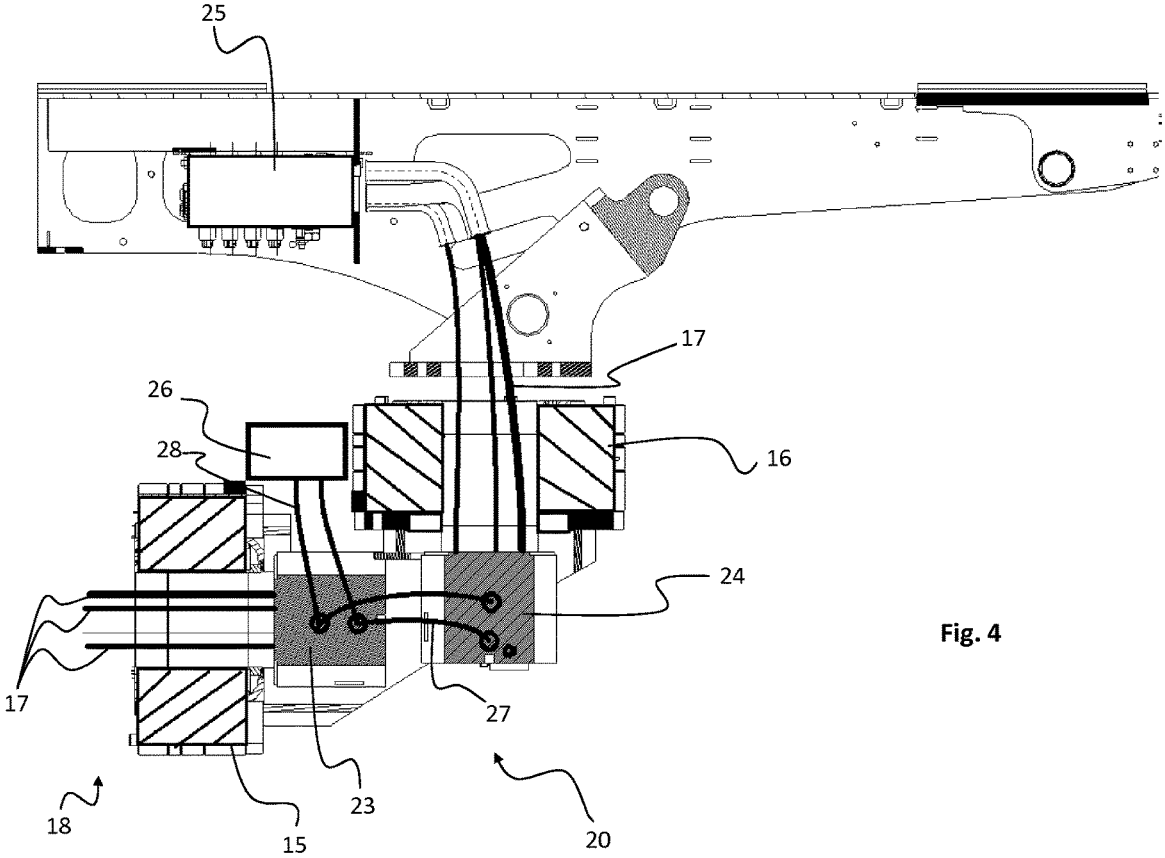
FIG. 4 is an illustrative view of a conduit arrangement at the free end of an extendable boom.

In the embodiment shown in FIG. 4, the hydraulic conduits 17, which are arranged for supply of hydraulic fluid to the hydraulic device arranged on the mounting device 11, extend through both the first and second rotation devices 15 and 16.

In another not shown embodiments the hydraulic conduits 17 are arranged through only one of the rotation devices, either the first or second rotation device 15 or 16. In such a case, the hydraulic conduits 17 are arranged past the other rotation device on the outside of it.

In the shown embodiment, the hydraulic conduits 17 are arranged through the free end 18 of the extendable boom 12, i.e. through the free end of the second telescopic section 14. The hydraulic conduits 17 extend substantially in parallel with the extendable boom 12 in the longitudinal direction D1 out from the free end 18 of the extendable boom 12. Specifically, the hydraulic conduits 17 are arranged to extend through an end part of the hydraulic cylinder 19 and further out through the free end 18 of the extendable boom 12. In the shown embodiment, the conduits 17 for supply to the hydraulic device are telescopically extendable, which will be more closely described below.

The first rotation device 15 is arranged at a free end 18 of the extendable boom 12, wherein the first rotation device 15 has a through hole and wherein the hydraulic conduits 17 are arranged through said through hole of the first rotation device 15. Further, in the shown embodiment, the second rotation device 16 also comprises a through hole, wherein the hydraulic conduits 17 are arranged through said through hole of the second rotation device 16. In a specific embodiment the rotation devices are hydraulically driven worm gear motors with an external drive allowing the hydraulic conduits 17 to pass through the centre of the first or second rotation device, or both. A skilled person will know that are other ways of providing a rotational motor with a central through hole allowing conduits to pass centrally, an example being a hydraulic motor with a centrally located swivel arrangement.

In order to allow the conduits to rotate with the rotation of the rotation devices a swivel arrangement 20 is arranged. In the shown embodiment, each conduit is swiveled twice, on both sides of an angle of about 90°. A first set of swivels 23 are arranged to allow the conduits extending through the first rotation device to rotate around an axis that is substantially parallel to the first axis or rotation A1 of the first rotation device 15. A second set of swivels 24 are arranged to allow the conduits 17 to rotate around an axis that is substantially parallel to the second axis of rotation A2 of the second rotation device 16. Each swivel may e.g. be a rotatable hose coupling. Instead of sets of individual swivels the swivel arrangement may comprise one or two multi-swivels providing a swivel connection for a plurality of hydraulic conduits.

Further, in a not shown embodiment such a multi-swivel may be a part of a rotation device 15 or 16, and provided centrally inside said rotation device. In such a multi-swivel the conduits may be connected axially to the multi-swivel of the first rotation device 15 from the inside of the extendable boom 12. The swiveled conduits may extend either axially or radially out from the free end of the extendable boom. A similar arrangement may be arranged at the second rotation device 16, with conduits arriving either radially or axially with respect to the second axis of rotation A2 from the first rotation device. The swiveled fluid conduits preferably extend axially out from the second rotation device 16 towards the hydraulic device arranged on the mounting device 11. If the conduits are arranged radially from the first rotation device 15, they will extend axially out from the second rotation device 16, whereas they may extend either radially or axially to the hydraulic device if the conduits enter axially from the first rotation device 15.

Between the sets of swivels 23 and 24 or multi-swivels, hydraulic connectors 27, e.g. individual connectors, are provided, which hydraulic connectors in conjunction with the set of swivels 23 and 24 form an angle that correspond to the angle between the first and second axis of rotation A1 and A2, respectively. In the shown embodiment, this angle is about 90°. The angle is preferably larger than 60° or more preferably larger than 80°, and smaller than 120°, more preferably smaller than 110° or even 100°. In one specific embodiment only one set of swivels, or one multi-swivel is arranged for any which one of the rotation devices, wherein the conduits are arranged to flex along with the rotation of the other rotation device.

A valve unit 25 is arranged at the mounting device 11, or in connection to the second rotation device 16. The valve unit 25 is arranged to provide the different functions of the hydraulic device with a hydraulic pressure. The valve unit 25 allows the number of conduits that need to be arranged to the hydraulic device to be minimised. At least one of the hydraulic conduits 17 is a pressure line from a pressure source arranged on the mining or construction vehicle. In addition to the at least one pressure line a return line leading to tank needs to be arranged. In a specific not shown embodiment, these are the only two hydraulic conduits that are arranged along, and preferably inside, the extendable boom 12.

A diverter valve 26, separate from the valve unit 25, may be arranged to provide the rotation motors 15 and 16 with pressurised hydraulic fluid.

In a specific embodiment, the hydraulic device is a rock drilling machine. A rock drilling machine normally needs three hydraulic pressurised inputs, a first input for the percussion of the drill string, a second input for the rotation of the drill string and a third input for the forward feed of the drilling machine in the drilling direction. In one embodiment, these three inputs may be provided from one combined hydraulic supply conduit. However, in many applications it may be advantageous to provide these different functions with separate supply lines, because the pressure and flow may vary greatly between different functions such that they may influence each other.

Figure 5:
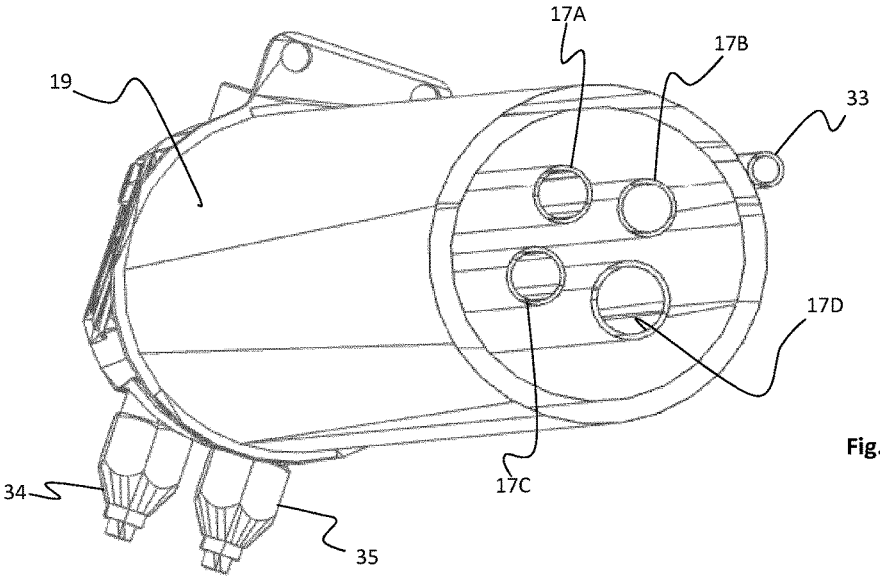
FIG. 5 is a view of hydraulic cylinder with an internal conduit arrangement.

FIG. 5 shows a partly cut view of an exemplary embodiment of hydraulic conduits 17A-D arranged inside a hydraulic cylinder 19 that is arranged to govern the extension of the extendable boom 12. In this embodiment, the hydraulic conduits 17 are comprised of four different conduits, a first conduit 17A to a percussive unit of the drilling machine, a second conduit 17B to a rotation motor of the drilling machine, a third conduit 17C to a feed device for feeding the drilling machine back and forth, and a fourth conduit 17D for a return flow to tank.

These are exemplary uses for the different conduits and it is obvious to a person skilled in the art that more conduits may be arranged, or less, and that other applications in need of a hydraulic supply may be used. Also shown in FIG. 5 are the hydraulic connections 34 and 35 providing the hydraulic cylinder 19 with hydraulic fluid, and a conduit 33 to the rod side of the hydraulic cylinder 19.

Figure 6:
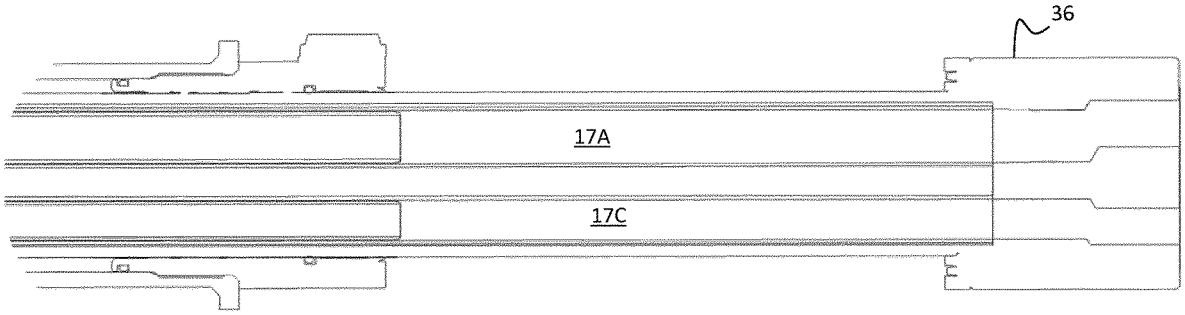
FIG. 6 is a longitudinal cut view of the hydraulic cylinder in FIG. 5.

FIG. 6 is a cut view along the longitudinal direction D1 of the hydraulic cylinder 19. From this view it is apparent that that each hydraulic conduit 17A-D is telescopic, comprising two tubular sections each, whereof a smaller tubular section is arranged to slide within a relatively larger tubular section. The individual hydraulic conduits may also comprise three or more telescopic sections. Specifically, the embodiment with three telescopic sections may be made neutral with respect to pressure and volume, such that a conduit may expand lengthwise without affecting its interior volume or the pressure inside it. As is apparent from FIG. 6 the hydraulic conduits 17 extend through the piston end part 36, substantially parallel with the longitudinal direction D1 of the extendable boom 12.

Figure 7:
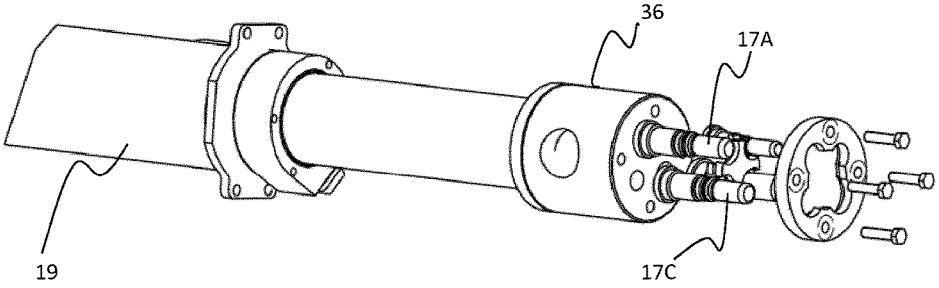
FIG. 7 is a perspective view of the piston part of a hydraulic cylinder.

In FIG. 7 it is shown how the hydraulic conduits 17 extend through the piston end part 36 from where they will continue through the free end of the extendable boom 12.

A sensor 21 is arranged to monitor the extension of the extendable boom 12 in the longitudinal direction D1. The sensor 21 may be arranged on anyone of the moving parts, i.e. on the extendable boom 12 or on the hydraulic cylinder 19. A control unit 22 is arranged to control operation of the hydraulic device and to monitor other operations of the mining or construction vehicle 10, see FIG. 1. The control unit 22 is inter alia arranged to monitor commands issued by an operator, such as commands relating to the extension of the extendable boom 12 in the longitudinal direction D1. The control unit 22 may physically be arranged anywhere, e.g. on the mining or construction vehicle 10, on the extendable boom 12, or at a distant location in communication with a communication unit at the mining or construction vehicle 10.

The control unit 22 is also arranged to compare the commanded extension of the extendable boom 12 with the actual extension as monitored by the sensor 21. Such a comparison may be made as a method of detecting a leak in anyone of the hydraulic conduits arranged inside the hydraulic cylinder 19. If the actual extension as monitored by the sensor 21 is greater than the commanded extension of the extendable boom 12 this may be due to a leak in one of the pressurised hydraulic conduits 17A-C. Namely, the leaking pressurised hydraulic fluid from the pressurised hydraulic conduits 17A-C will leak into the hydraulic cylinder, mixing with the hydraulic fluid of the hydraulic cylinder and causing the piston of the hydraulic cylinder to extend so as to extend the extendable boom 12. Alternatively, if a low-pressure conduit, such as the return conduit 17D, is broken fluid may leak from the hydraulic cylinder and into said return conduit 17D such that an undesired retraction of the extendable boom may be noted.

If such undesired extension or retraction is noted, i.e. if the monitored extension does not correspond to the commanded extension, an alert signal may be issued, or under certain conditions the system may be shut down and/or the operation interrupted. The operation may be resumed only after the problem has been identified and attended to. The distinction between issuing a warning signal and system shut down may be decided by the magnitude of the discrepancy, such that when a discrepancy exceeding a first threshold is noted a warning signal is issued, and when a discrepancy exceeding a second threshold, which is greater than the first threshold, is noted the system is shut down and/or the operation interrupted. In a specific embodiment, the control unit 22 may be arranged to govern a compensation of the discrepancy, e.g. by providing excess hydraulic fluid to a hydraulic cylinder from which hydraulic fluid is lost into a low-pressure conduit, or to allow hydraulic fluid to escape from a hydraulic cylinder into which hydraulic fluid leak from a high-pressure conduit. Such compensation is hence governed by means of the control unit to make sure that a small leak is compensated for. If it becomes apparent that such compensation is not successful or does not meet a desired level of accuracy, e.g. if a discrepancy exceeding a specific threshold is noted, the operation may be aborted.

The arrangement of detecting leaks inside a hydraulic cylinder may be used irrespective of where the hydraulic cylinder is arranged. It is however specifically useful in applications where a hydraulic device is arranged on an extendable boom such that hydraulic conduits will need to be arranged along or inside the extendable boom.

The control unit 22 may also be arranged to control the operation of the hydraulic device in dependence of the extension of the extendable boom 12. Typically, a hydraulic device includes a hydraulic motor that works in a specific frequency. In the example where the hydraulic device is a drilling machine it comprises a percussion hammer producing strong hydraulic pulses by means of which a drill string is intermittently pushed further into the material being drilled to form a bore hole into/through the same. These pulses are produced with a specific frequency, which is adaptable as one of several drilling parameters in order to optimize a drilling operation. Conventionally, the frequency may e.g. be adapted as a function of the properties of the material in which the drilling is performed.

A problem that needs to be considered with extendable hydraulic conduits 17 is the vibration of the hydraulic device, which may cause resonance problems in the hydraulic conduits. Resonance may lead to detrimental vibrations causing instability, fatigue and, as a worst case, total breakdown of the system. Each conduit may be regarded as a trombone pipe with a specific resonance frequency, which is a direct function of the length of said hydraulic conduit. If this resonance frequency coincides with a frequency of a vibrating or oscillating hydraulic device, such as a rotating drilling machine or a percussion hammer, the conduit may start to self-oscillate, thereby risking serious negative consequences. Especially, the frequency of a percussive hammer of a hydraulic percussion rock drill needs to be considered. The percussions of the percussive creates pulsations that may propagate backwards through the hydraulic medium in the first conduit 17A to a percussive unit of the drilling machine. During a continuous drilling operation, these pulsations will have a frequency corresponding to the frequency of the percussive hammer.

Therefore, the control unit 22 may be arranged to operate a hydraulic device such as a percussive drilling machine so as to avoid operating frequencies that has been identified to be prone to produce resonances and/or self-oscillation. Hence, drilling frequencies that may be prone to produce resonances are identified for specific extensions of the extendable boom 12. Subsequently, during a drilling operation, the control unit 22 is arranged to compare a current extension of the extendable boom 12 with a current drilling frequency of the drilling machine. If it is noted that a commanded drilling frequency may be prone to produce a resonance at the current extension of the extendable boom 12, the control unit will issue a warning or a command to avoid said commanded drilling frequency. The drilling machine may then be set to operate at a different drilling frequency that has not been identified as prone to produce a resonance at the current extension of the extendable boom 12, or the extension of the extendable boom 12 may be altered.

However, often during a drilling operation, it is desired not to move the mining or construction vehicle 10 or to adjust its position or settings, e.g. by changing the extension of the extendable boom 12. However, in most operation the frequency range that will be used for a specific operation will be known before start of the operation. Therefore, the set-up of the drilling or construction vehicle preferably set up so as to avoid an extension of the extendable boom corresponding to a length of a hydraulic conduit that may risk to interfere with the drilling frequency range to be used. Namely, often it is possible to locate a hydraulic device arranged in connection to an extendable boom, and specifically, a drilling end of a drilling machine at one specific location by adapting other parameters than the extension of the extendable boom, such as e.g. the position of the drilling or construction vehicle, the angles of the extendable boom with respect to both the vehicle and/or the feed beam.

Therefore, in order to avoid resonance in a hydraulic conduit during an ongoing drilling operation, it is possible to adjust the drilling frequency, but for most applications it desirable to adapt the position of the vehicle, e.g. drill rig, beforehand so as to make sure that the desired drilling frequencies may be used without causing problems.

In a specific embodiment, an attenuator may be arranged to attenuate the vibration of the hydraulic conduits. The fact that the hydraulic conduits 17 are arranged inside the hydraulic cylinder 19, embedded in a hydraulic fluid, will dampen their possibilities to oscillate and hence also restrict the self-oscillation of the hydraulic conduits 17. This is particularly useful for the conduit 17A to the percussive unit of the drilling machine, and in one embodiment only the conduit 17A to the percussive unit of the drilling machine is embedded inside the hydraulic cylinder 19. Nevertheless, it may still be of importance to dampen the possibility of self-oscillation of the hydraulic conduits 17 by avoiding specific drilling frequencies in combination with specific extensions of the extendable boom 12.

A hydraulic feed system 31 comprising a supply tank and a pump may be arranged in connection to the hydraulic cylinder 19 to compensate a fluid volume in at least one of the hydraulic conduits 17 for supply to a drilling machine. When the extendable boom 12 is extended, the volume inside the hydraulic conduits 17 is increased. The control unit 22 may be part of the hydraulic feed system and is arranged to control a compensation by supplying a hydraulic flow to the hydraulic conduit corresponding to the increased volume of said hydraulic conduit. Correspondingly, when the extendable boom 12 is compacted, the control unit 22 may be configured to control a compensation by allowing a hydraulic flow corresponding to the decreased volume of said hydraulic conduit to escape from the hydraulic conduit. In order to avoid cavitation and a negative pressure in the hydraulic conduits a consumer may be connected to the return line to make sure that too much hydraulic fluid is not drawn from the conduits.

Figure 8:
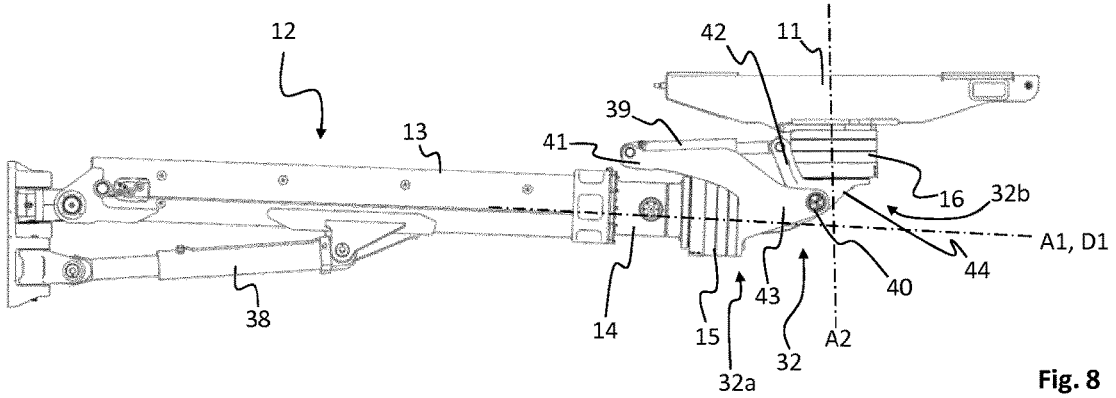
FIG. 8 is a schematic view of a boom with an alternative angle unit.
Figure 9:
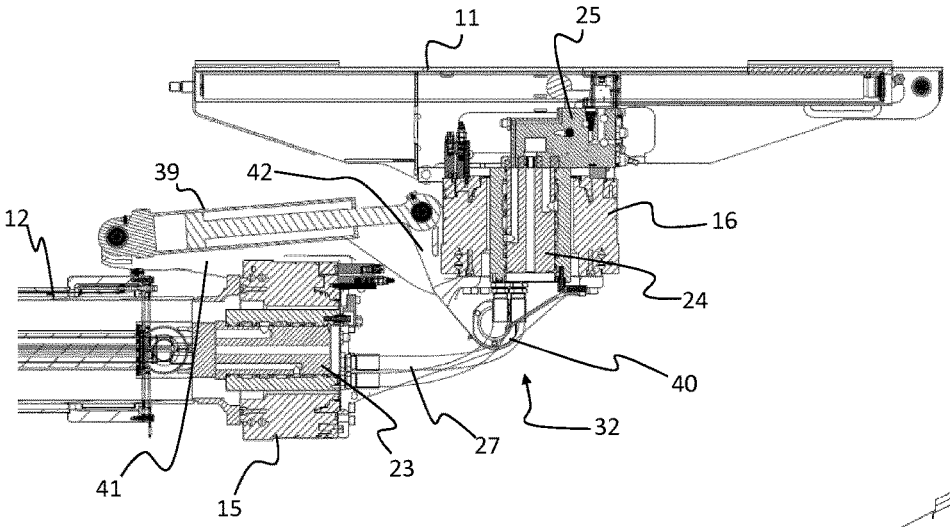
FIG. 9 is a sectional view of the alternative angle unit of FIG. 8.
Figure 10:
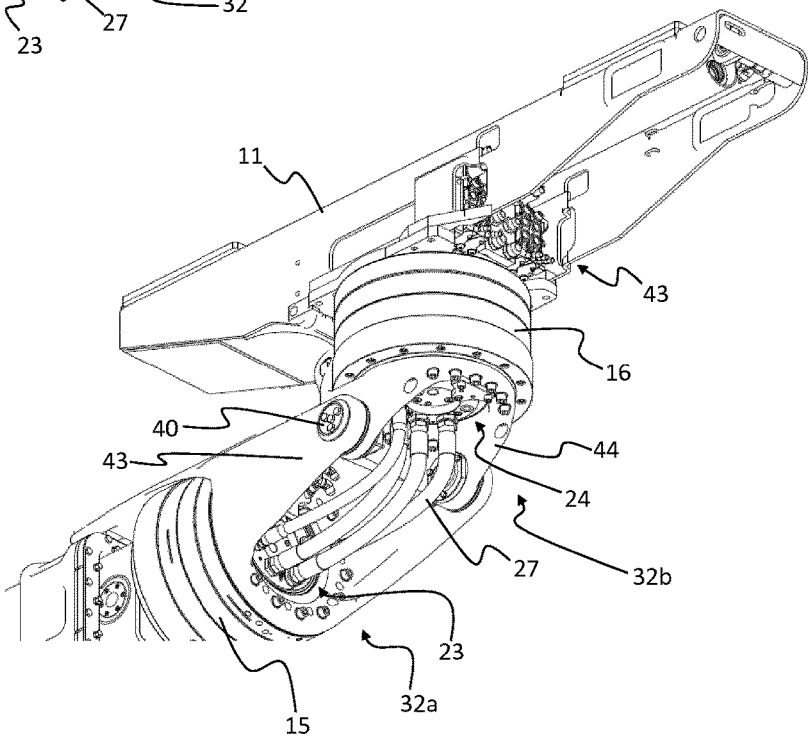
FIG. 10 is a perspective view of the alternative angle unit of FIG. 8.

In FIGS. 8-10 an alternative angle unit 32 is shown. This angle unit 32 is arranged on a boom 12 extending in a first direction D1. The boom 12 is connected to a mining or construction device arranged on a mounting device 11, via a first and a second rotation device 15, and 16, arranged in connection to the free end of said boom 12. The mining or construction device is preferably a device for producing holes in a rock or the like, e.g. a rock drilling device. In a specific embodiment it is a hydraulic rock drilling machine.

Preferably the mining or construction device is a drill rig including a rock drilling machine arranged on a mounting device 11.

Preferably the boom 12 is extendable, comprising a first telescopic section 13 and second telescopic section 14.

The first rotation device 15 is arranged to provide a rotation around a first axis A1 that is substantially parallel to the first direction D1, and the second rotation device 16 is arranged to provide a rotation around a second axis A2 that is arranged at an angle with respect to the first axis A1. In an alternative embodiment, the first rotation device 15 is arranged inside the boom, specifically an extendable boom. In such an arrangement the second telescopic section 14 is cylindrical and arranged with splines inside the first telescopic section 13. The first rotation device may be arranged inside the first telescopic section 13 to be translated along with the inner end of the second telescopic section 14. Such an arrangement is described in detail in EP 0 434 652 and may be implemented on the inventive mining or construction vehicle.

The angle unit of this embodiment is different with respect to the embodiment shown in FIGS. 1-4. Namely, in contrast to the embodiment shown in FIGS. 1-4 a pivot point 40 is arranged between said first and second rotation devices 15 and 16 to provide an angular movement of said second axis A2 of said second rotation device 16 with respect to said first axis A1 of said first rotation device 15. Conventionally, such a pivot point 40, if at all present, is arranged outside of both the rotation devices 15 and 16. The angular movement may be used to alter the tilt angle of a feed beam, not show, including a drilling machine arranged on the mounting device 11 into suitable drilling angles. Except from this difference the arrangements of the different embodiments of the angle unit 32 may be combined in any possible way.

As noted above, the angle unit 32 of the embodiment shown in FIGS. 8-10 comprises a pivot point 40 arranged between said first and second rotation devices 15,16 and a pressure cylinder 39 arranged to provide the angular movement of the second axis A2 of the second rotation device 16 with respect to the first axis A1 of said first rotation device 15 around said pivot point 40. In the shown embodiment, the first rotation device 15 is arranged at the outer end of second telescopic section 14 of an extendable boom 12. Thereby, space is limited for the arrangement of the angle unit 32.

In view of the limited space between the first and second rotation devices 15,16 a first arm 41 extends backwards with respect to the direction D1 of the boom 12, so as to prolong the working length of the pressure cylinder 39 and make it possible to have a shorter angle unit 32 between the rotational units 15, 16. Specifically, the first arm 41 is arranged to extend backwards with respect to the first direction D1 of the boom 12 from a point at an outer end of said boom 12 so as to rotate with said rotation device 15, said first arm 41 being connected at a first end of the pressure cylinder 39. The opposite, second end of the pressure cylinder 39 is connected to a second arm 42 arranged at the second rotation device 16. The arms 41 and 42 may be a narrow arm structure as shown in FIGS. 8-10 or a structure partly or fully enclosing the rotational devices 15, 16.

The angle unit 32 shown in FIG. 8-10 comprises a first part 32*a* connected to the first rotation device 15 and a second part 32*b* connected to the second rotation device 16 wherein the first and second parts of the angle unit 32 are connected to each other in the pivot point 40. The first arm 41, which extends backwards with respect to the direction D1 of the boom 12 and rotates with the rotation device 15, extends past the connection between the first part and the first rotation device 15. The second arm 42 is connected to the second part and extends along the second axis A2 past the connection between the second part and the second rotation device 16. The arms 41 and 42 may be made integral, welded or bolted to the first and second parts of the angular unit 32. An alternative design, not shown, would be to make the first and/or second parts of the angle unit 32 longer to include the connection points for the pressure cylinder 39. However this will increase the length along the axis A1 and/or A2 and size of the angle unit in a non-desired way. The angle unit 32 is preferably bolted to the first and second rotational device 15, 16 for easy connection and disconnection.

In the shown embodiment second arm 42 extends past at least a part of the second rotation device 16 along the second axis A2. The main object of the second arm 42 in this embodiment is not to increase the pivot length with respect to the pivot point 40, but to allow a compact and reliable arrangement. Therefore, the second arm 42 extend along the second axis A2 past at least a part of the second rotation device 16, thereby allowing the pressure cylinder 39 to be arranged inside the angle between the first and second axis A1 and A2. Thereby, an extension of the pressure cylinder 39 will act to increase the angle between the first axis A1 and the second axis A2 and a retraction of the pressure cylinder 39 will act to decrease said angle.

In an alternative, not shown embodiment, one or two pressure cylinders may be arranged at the outer end of the angle arrangement, i.e. on the outside of the angle, such that a extension of the pressure cylinder 39 will act to decrease the angle between the first axis A1 and the second axis A2 whereas a retraction of the pressure cylinder 39 will act to increase said angle. In this alternative the second arm 42 will extend in the opposite way, along the second axis A2, away from the second rotation device 16. In this way, the outer end of the second arm will become visible below the boom 12.

In the shown embodiment the first part 32*a* of the angle unit comprises a first hinge limb pair 43 that extends from the first rotation device 15 and is connected at the pivot point 40 to a second hinge limb pair 44 of the second part 32*b* of the angle unit. As is visible in FIG. 10, the hydraulic connectors 27 are arranged to pass between the first hinge limb pair 43, inside the pivot point 40 and between the second hinge limb pair 44. Hence, in this embodiment, the pivot point is comprised of two spaced apart hinges, connecting the first and second hinge limb pairs 43 and 44 to each other and providing a space in between allowing e.g. the hydraulic conduits 27 to pass inside said spaced apart hinges.

In the embodiment shown in FIGS. 9 and 10 the first rotation device 15 comprises a first swivel arrangement 23 and the second rotation device 16 comprises a second swivel arrangement 24 for supply of hydraulic fluid to the hydraulic device on the mounting device 11. Hydraulic connectors 27, typically in the form of flexible conduits, are arranged to connect the first swivel arrangement 23 to the second swivel arrangement 24.

Also, in the shown embodiment, a valve unit 25 for the distribution of hydraulic fluid to and from the hydraulic device is arranged in direct connection to the second swivel arrangement 24. They may eve be arranged as one integral unit. The close connection between the valve unit 25 and the second swivel arrangement 24 is advantageous as it saves place and it is made possible in that the pivot point is arranged between the first and second rotation devices 15 and 16. Namely, with such an arrangement, the hydraulic conduits downstream of the second rotation device 16 need only be compensated for the translational movement of the hydraulic device along the feed beam 11, which is predictable and easily compensated for. The hydraulic connectors 27 arranged between the swivels 23 and 24 are configured to cope with the angular movement of the angle unit 32. In a similar way, the hydraulic conduits 17 through the piston end part 36 may be directly connected to the first swivel arrangement 23.

In the shown embodiment the hydraulic fluid to and from the hydraulic device is arranged through the first and second swivels 23 and 24 arranged in connection to the first and second rotation devices 15 and 16, respectively. The swivels 23 and 24 may be fully or partly located in opening through the rotation devices 15 and 16. In an alternative, not shown embodiment, the hydraulic conduits may be arranged in a more conventional manner outside of the boom 12 and/or the angle unit 32. The use of a pivot point arranged between the first and second rotation devices 15 and 16 is hence not dependent of that the hydraulic conduits are internally drawn. For an arrangement where the hydraulic conduits are drawn around the angle unit 32 other types of motors, which do not include a hole through their centres, may be utilised.

Above, the invention has been described with reference to specific embodiments. The invention is however not limited to these embodiments. It is obvious to a person skilled in the art that other embodiments are possible within the scope of the following claims. The terms "comprising" and "comprised of" is used in this application in a non-exclusive meaning, such that all comprised parts may be completed with additional parts.

The invention claimed is:

1. An extendable boom comprising at least a first telescopic section and a second telescopic section, wherein the first telescopic section and the second telescopic section extend in a longitudinal direction, wherein the first telescopic section is arranged to be connected to a mining or construction vehicle and a hydraulic device is arranged to be connected to a mounting device in connection to a free end of the second telescopic section, wherein the hydraulic device is a hydraulic percussive drilling machine, wherein at least one hydraulic conduit for supply of hydraulic fluid to the hydraulic device connected to the mounting device is arranged inside the extendable boom, wherein in order to allow the at least one hydraulic conduit to rotate with a rotation of a rotation device, a swivel arrangement is arranged, wherein the at least one hydraulic conduit for the supply of the hydraulic fluid to the hydraulic device is arranged inside a hydraulic cylinder, and wherein the hydraulic cylinder is arranged inside the extendable boom.

2. The extendable boom according to claim 1, wherein the at least one hydraulic conduit is arranged through the free end of the second telescopic section of the extendable boom.

3. The extendable boom according to claim 2, wherein the at least one hydraulic conduit extends substantially in parallel with the extendable boom in the longitudinal direction out from the free end of the second telescopic section of the extendable boom.

4. The extendable boom according to claim 1, wherein the at least one hydraulic conduit for supply to the hydraulic device is telescopically extendable.

5. The extendable boom according to claim 1, wherein the hydraulic percussive drilling machine comprises a percussive unit and wherein the at least one hydraulic conduit is arranged to supply the percussive unit with the hydraulic fluid.

6. The extendable boom according to claim 1, wherein four different hydraulic conduits are arranged alongside inside the extendable boom, a first conduit to a percussive unit of the drilling machine, a second conduit to a rotation motor of the drilling machine, a third conduit to a feed device for feeding the drilling machine back and forth, and a fourth conduit for a return flow to tank.

7. The extendable boom according to claim 1, further comprising a hydraulic cylinder, in which at least one hydraulic conduit is arranged for feeding pressurised hydraulic fluid to a hydraulic device, wherein the hydraulic cylinder is arranged in connection to the extendable boom to govern extension of the extendable boom; a command unit arranged to command the extension of the hydraulic cylinder; a sensor arranged to monitor the extension of the hydraulic cylinder; and a control unit arranged to compare said monitored extension with the commanded extension.

8. The extendable boom according to claim 7, wherein the hydraulic device is a hydraulic percussive drilling machine comprising a percussive unit and wherein the hydraulic conduit is arranged to supply the percussive unit with hydraulic fluid.

9. The extendable boom according to claim 7, wherein an alert signal is issued when the control unit detects a discrepancy between the monitored extension and the commanded extension of the hydraulic cylinder.

10. The extendable boom according to claim 7, wherein a feed system is arranged to compensate a fluid volume in the at least one hydraulic conduit for supply of hydraulic fluid to the hydraulic device, and wherein the control unit is arranged to control a supply of hydraulic fluid to the at least one hydraulic conduit corresponding to the increased volume of said at least one hydraulic conduit, and, when the at least one hydraulic conduit is compacted, the control unit is arranged to control a discharge of hydraulic fluid from the at least one hydraulic conduit corresponding to the decreased volume of said at least one hydraulic conduit due to that it is being compacted.

11. The extendable boom according to claim 7, wherein the hydraulic device is a rock drilling machine that may operate at different hammering frequencies, and wherein the control unit is arranged to control the operation of the drilling machine so as to avoid hammering frequencies that have been identified to be prone to produce resonances in the at least one hydraulic conduit and/or to control the extension of the extendable boom so as to avoid a length of the at least one hydraulic conduit that may interfere with a desired hammering frequency.

12. A mining or construction vehicle comprising the extendable boom according to claim 1.

13. The mining or construction vehicle according to claim 12, wherein the mining or construction vehicle is a drill rig.

14. An extendable boom comprising at least a first telescopic section and a second telescopic section, wherein the first telescopic section and the second telescopic section extending in a longitudinal direction, wherein the first telescopic section is arranged to be connected to a mining or construction vehicle and a hydraulic device is arranged to be connected to a mounting device in connection to a free end of the second telescopic section, wherein the hydraulic device is a hydraulic percussive drilling machine, wherein at least one hydraulic conduit for supply of hydraulic fluid to the hydraulic device connected to the mounting device is arranged inside the extendable boom, wherein in order to allow the at least one hydraulic conduit to rotate with a rotation of a rotation device, a swivel arrangement is arranged, and wherein four different hydraulic conduits are arranged alongside inside the extendable boom, a first conduit to a percussive unit of the drilling machine, a second conduit to a rotation motor of the drilling machine, a third conduit to a feed device for feeding the drilling machine back and forth, and a fourth conduit for a return flow to a tank.

15. The extendable boom according to claim 14, wherein the at least one hydraulic conduit is arranged through the free end of the second telescopic section of the extendable boom.

16. The extendable boom according to claim 15, wherein the at least one hydraulic conduit extends substantially in parallel with the extendable boom in the longitudinal direction out from the free end of the second telescopic section of the extendable boom.

17. The extendable boom according to claim 14, wherein the at least one hydraulic conduit for supply to the hydraulic device is telescopically extendable.

18. The extendable boom according to claim 14, wherein the hydraulic percussive drilling machine comprises a percussive unit and wherein the at least one hydraulic conduit is arranged to supply the percussive unit with the hydraulic fluid.

* * * * *